United States Patent [19]

Dainin

[11] Patent Number: 4,838,133

[45] Date of Patent: Jun. 13, 1989

[54] HYDRAULIC PULSE WRENCH

[75] Inventor: Takashi Dainin, Higashiosaka, Japan

[73] Assignee: Nippon Pneumatic Manufacturing Co., Ltd., Japan

[21] Appl. No.: 101,963

[22] Filed: Sep. 28, 1987

[51] Int. Cl.[4] ..... B25B 7/02

[52] U.S. Cl. ..... 81/465; 81/466; 81/463; 173/93.5

[58] Field of Search ..... 81/465, 464, 466, 470, 81/463; 173/93, 93.5 X

[56] References Cited

U.S. PATENT DOCUMENTS 3,196,636 7/1965 Piatt et al. ..... 173/93

4,418,764 12/1983 Mizobe ..... 81/470

4,553,948 11/1985 Tatsuno ..... 173/93.5

*Primary Examiner*—Frederick R. Schmidt

*Assistant Examiner*—Lawrence Cruz

*Attorney, Agent, or Firm*—Wenderoth, Lind & Ponack

[57] ABSTRACT

An improved hydraulic pulse wrench provided with a hydraulic pulse generator has a liner, an anvil rotatably mounted in the liner and having a longitudinal slit, and two blades loosely mounted in the longitudinal slit. The liner has an elliptic hole. The two blades have their outer edges beveled in different directions. The anvil has a pair of axial ridges and the liner has on its inner periphery a total of five axial ridges. The blades, anvil and liner cooperate with one another to form pressure chambers while the liner is rotated.

2 Claims, 2 Drawing Sheets

HYDRAULIC PULSE WRENCH

Figure 1:
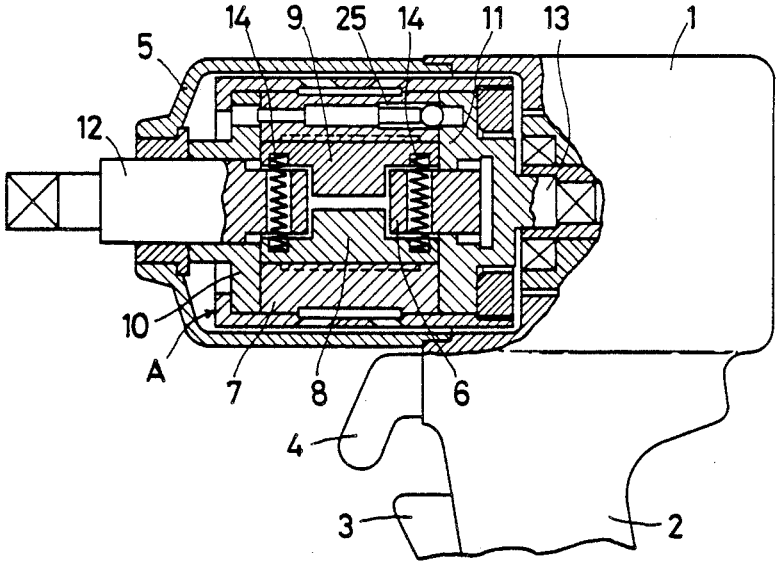

The present invention relates to a hydraulic pulse wrench provided with a hydraulic pulse generator which works as a substitute for a conventional striking tool such as a mechanical impact mechanism.

A hydraulic pulse wrench is known which has a hydraulic pulse generator rotatably mounted in a casing and including a liner and an anvil provided with blades, an output shaft integral with the anvil and protruding from the front end of the casing, and an air motor provided to the rear of the liner for driving the liner. A turning tool secured to the end of the output shaft is engaged with a nut or the like to tighten or loosen it by the operation of the pulse wrench. When the resistance to the anvil increases to prevent it from rotating with the output shaft while tightening a nut or the like, the oil confined between the liner and the anvil produces an impact turning torque.

Such an impact torque is generated owing to a high pressure created in one of a pair of oil chambers formed between the anvil and the liner and partitioned by a blade. Since it is a common practice with the prior art torque wrench to use a single blade and thus to shape the anvil and the liner asymmetrically in cross-section, vibrations are inevitably generated.

In order to produce a large impact force, it is required to provide a large-sized blade. To accommodate such a blade, the wrench itself also has to be large in size.

Some of the prior art wrenches employ a two- or four-blade construction. But they have a rather complicated mechanism and thus are troublesome to assemble.

In the pulse wrench according to the present invention, as with the prior art, while the resistance to rotation of the output shaft is relatively small, the anvil rotates, keeping pace with the liner with the oil interposed therebetween. But, as the nut is tightened harder and offers more resistance, the speed of rotation of the anvil begins to fall behind that of the liner, until the sealing ridges on the anvil come into sealing contact with the corresponding sealing ridges on the liner and simultaneously the top ends of the blades sealingly contact the respective sealing ridges on the liner to increase the oil pressure in the high-pressure chambers and produce an impact.

Another half turn of the liner from this position will bring the sealing ridges on the anvil again into sealing contact with the corresponding sealing ridges on the liner, but keep the outer ends of the blades spaced from the corresponding sealing ridges on the liner. Thus no increase in the oil pressure occurs in this position. It will be appreciated from the foregoing that one impact is produced for every rotation of the liner.

Since the anvil of the present invention is provided with two blades and will produce one impact for each rotation, the anvil and liner do not have to be formed asymmetrically. This minimizes the generation of vibrations. The blades mounted in the anvil have their outer ends tapered or beveled in different directions so that the line connecting the tips of the blades will be in an offset position with respect to the center of rotation of the anvil. Thus the anvil can have a perfect laterally symmetrical shape. Also since the two blades have the same shape and have only to be mounted oppositely to each other when assembling the wrench, the wrench is easy to manufacture as well as to assemble.

The anvil has on its outer periphery an opposed pair of axial sealing ridges extending in a direction perpendicular to the blade mounting portions. The liner has on its inner periphery the axial sealing ridges in the direction of the breadth of the inner periphery which are adapted to sealingly contact the sealing ridges on the anvil and with the axial sealing ridge in the direction of its length at one side adapted to sealingly contact the tip of the blade whether in the normal or reverse turn position and at the outer side with the two axial sealing ridges each adapted to sealingly contact the tip of the blade when in the normal turn position and in the reverse turn position, respectively. Thus a sufficient impact will be created both in the normal and reverse turn positions.

Figure 2:
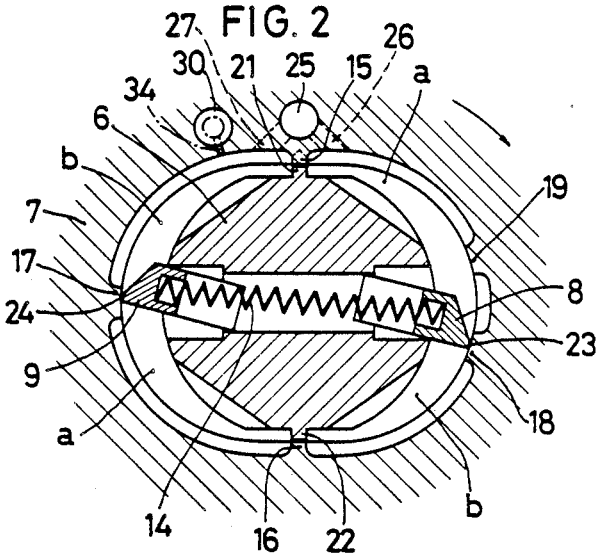
Figure 3:
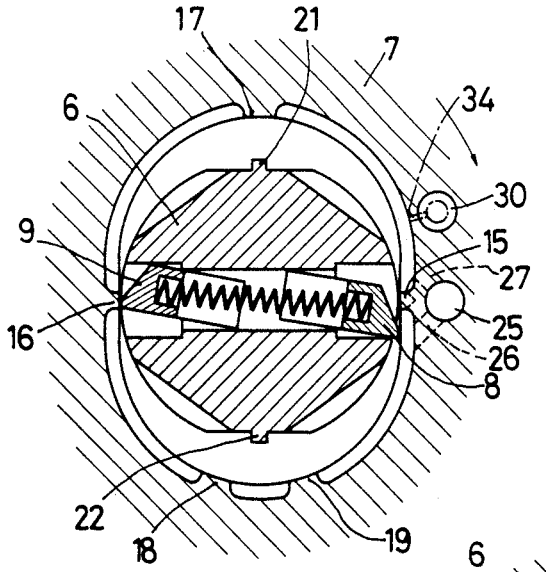
Figure 4:
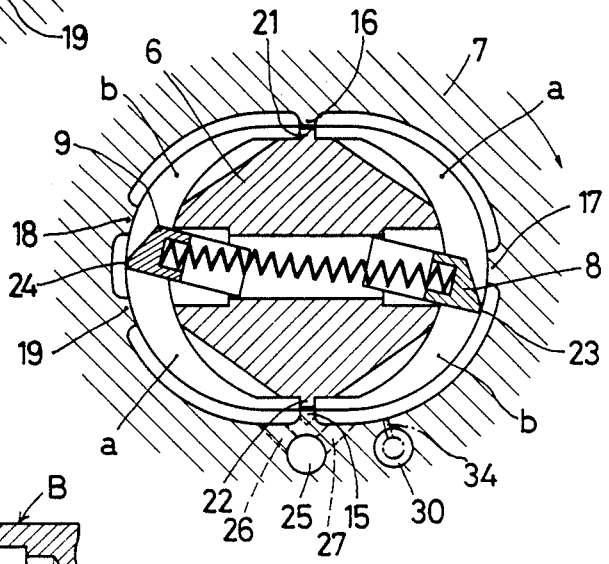

Other features and objects of the present invention will become apparent from the following description taken with reference to the accompanying drawings, in which:

FIG. 1 is a vertical sectional side view of a portion of the pulse wrench according to the present invention; and FIGS. 2–4 are enlarged cross-sectional views showing how the pulse wrench operates.

Referring to the drawings, numeral 1 in FIG. 1 designates a body of the pulse wrench according to the present invention. A conventional air motor is mounted in the body. On the bottom of the body 1 is formed a handle 2 in which are mounted a valve for switching on and off the air motor and a valve for reversing the direction of rotation of the air motor. These valves are actuated by an ON/OFF lever 3 and a lever 4 for reversing the direction of rotation which are provided in the front of the handle 2.

To the front end of the body 1 is fixedly mounted a casing 5 which houses a hydraulic pulse generator A according to the present invention. This power transmission device comprises an anvil 6, a liner 7 mounted on the anvil 6 and two blades 8 and 9 loosely mounted in a longitudinal slit cut through the anvil 6. The liner 7 has an elliptic inner periphery arranged eccentrically with respect to the center of rotation of the anvil 6. The blades 8 and 9 are biased away from each other by springs 14 so as to be pressed against the inner surface of the liner 7.

The liner 7 is provided at its front end with a front wall 10 and at its rear end with a rear wall 11. On the front end of the anvil 6 is provided an output shaft 12 protruding through the front wall 10. On the back of the rear wall 11 is integrally provided a shaft 13 which is connected to the output shaft of the air motor.

The liner 7 is rotatable with respect to the anvil 6 and has on its inner periphery an opposed pair of sealing ridges 15 and 16 extending parallel to the axis at positions corresponding to the ends of the minor axis of the ellipse and a sealing ridge 17 parallel to the axis and at a position corresponding to one end of the major axis and two sealing ridges 18 and 19 extending parallel to the axis and at a position corresponding to the other end.

The anvil 6 has in turn an opposed pair of sealing ridges 21 and 22 on its outer periphery extending parallel to the axis of the anvil and adapted to sealingly contact the sealing ridges 15 and 16 on the liner, respectively.

The blades 8 and 9 have their outer ends 23 and 24 tapered or beveled. Since they are beveled in different or asymmetrical directions, the line connecting the ends 23 and 24 is offset with respect to the center of rotation of the anvil 6.

A relief valve 25 provided in a relief duct serves to adjust the flow rate of fluid through the duct and thus to adjust the impact strength.

An automatic oil supply unit B comprises an axial oil storage chamber 30, a pressure valve 31 slidably mounted in the chamber and a spring 32 for biasing the valve 31 to pressurize the oil in the chamber. The oil storage chamber 30 has a female thread in its rear periphery into which is inserted a threaded plug 33. The oil storage chamber 30 has its front portion in communication with the low pressure chamber b through a small diameter hole 34. In assembling, after the front portion of the chamber 30 has been filled with oil, the valve 31, the spring 32 and a collar 35 are inserted one after the other into the chamber 30, leaving enough space between the valve 31 and the collar 35 to allow the valve 31 to move back. Finally the threaded plug 33 is put into threaded engagement with the female thread to seal up the rear end of the chamber 30. "O" rings are fitted in annular grooves formed in the outer periphery of the valve 31 and in the front outer periphery of the threaded plug 33 to maintain the airtightness and liquid-tightness in the chamber 30.

In operation, a turning tool (not shown) fixed to the end of the output shaft 12 is engaged with a nut to be tightened and the lever 3 is pressed with the lever 4 set in a normal turn position.

The air motor will start to turn the liner 7 of the hydraulic pulse generator A clockwise in the direction of arrows in FIGS. 2, 3 and 4. At the beginning, since the turning of the nut meets hardly any resistance, the rotation of the liner 7 is smoothly transmitted through oil in high-pressure chambers a to the blades 8 and the anvil 6 to rotate the output shaft 12 and thus the nut at a high speed.

As the nut is turned to tighten harder against the object to be held, the load on the nut grows gradually, so that the nut will become difficult to turn, thus increasing the resistance to the turning of the anvil 6. Since the liner 7 keeps rotating at a constant speed all the while, the speed of rotation of the anvil 6 and the blades 8 and 9 begin to fall behind that of the liner 7, which results in the contraction of the volume of the high-pressure chambers a and the expansion of the volume of low-pressure chambers b.

In the state shown in FIG. 2, the sealing ridges 21 and 22 on the anvil 6 are in sealing contact with the sealing ridges 15 and 16 on the liner and at the same time the sealing ridges 17 and 18 on the liner 7 are in sealing contact with the end faces 23 and 24 of the blades 8 and 9, respectively, and a high pressure is created in each high-pressure chamber a. The high-pressure oil in the chambers acts to the blades 8 and 9, giving an impact on the anvil 6 to produce a desired impact torque.

When the liner 7 further turns by 90 degrees to the position shown in FIG. 3, the sealing ridges 21 and 22 on the anvil 6 are kept clear of any of the sealing ridges 15, 16, 17, 18 and 19 on the liner 7, keeping the chamber formed between the anvil 6 and the liner 7 at the same pressure level. Thus in this state no impact is produced.

When the liner 7 turns further by 90 degrees to the position as shown in FIG. 4, the sealing ridges 21 and 22 on the anvil 6 are brought into sealing contact with the sealing ridges 16 and 15 on the liner 7, respectively, whereas the blades 8 and 9 are clear of any of the sealing projections 17, 18 and 19 on the liner 7, putting the high-pressure chambers a in communication with the low-pressure chambers b. Thus in this state, no impact is produced either.

When the liner 7 further turns from the position of FIG. 4 by 180 degrees in the same direction to return to the position of FIG. 2, another impact is produced. When the liner 7 is turned in the reverse direction, the blades 8 and 9 will be inclined opposite to the way as shown in the drawings. Thus an impact force is produced at the position of FIG. 4.

Part of the oil in the high-pressure chamber a flows to the low-pressure chamber b through a passageway 26 with its flow rate throttled on its way by the relief valve 25 so as to control the increase in the pressure difference between the chambers a and b to keep it below a predetermined value, thus keeping the impact torque which acts on the blades 8 within a uniform level.

This action takes place at every rotation of the liner 7 to impart an impact torque to the output shaft 12 and tighten the nut. In order to loosen the nut, the lever 4 is shifted to the reverse position to reverse the air motor, thus reversing the hydraulic pulse generator.

As the wrench is operated some of, the oil in the chambers a and b leaks and the volume thereof in the chambers is reduced. In this embodiment, however, since the oil in the storage chamber 30 is normally pressurized by the pressure valve 31 biased by the spring 32, part of the oil in the chamber 30 will flow into the chambers a and b through the narrow hole 34 whenever there is a reduction in the volume of oil in the chambers a and b to make up for such a reduction.

Figure 5:
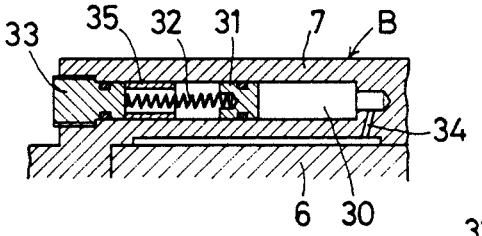
Figure 6:
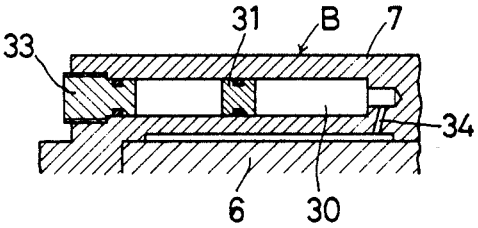

In another embodiment shown in FIG. 6, a high pressure gas is sealed between the valve 31 and the threaded plug 33 to pressurize the valve 31. This arrangement performs substantially the same function as that shown in FIG. 5.

It is usually difficult for the torque wrench of this type to keep on operating for a long time without causing the oil temperature in the liner 7 to rise and thus causing its volume to expand. Since such an expansion of volume of the oil makes difficult a normal operation of the relief valve 25 and thus hampers a smooth rotation to produce an impact torque, it is necessary to provide an accummulator in the liner to suck up any excess oil. According to the present invention, the valve 31 of the automatic oil feeding assembly B can move backwardly to increase the volume of the storage chamber 30 to act as an accumulator. However, since the storage chamber 30 is small in volume for an accumulator, it is preferable to provide an accumulator in addition the storage chamber 30.

What is claimed is:

1. A hydraulic pulse wrench, comprising:

a casing;

an output shaft in said casing;

a drive means in said casing; and a hydraulic pulse generator in said casing connected between said drive means and said output shaft and having a liner driven by said drive means about a liner axis of rotation, an anvil rotatably mounted for rotation about an anvil axis of rotation in said liner and which is eccentric to the liner axis of rotation, said anvil having a longitudinal slit therethrough, and two blades loosely mounted in said longitudinal slit and having edges projecting out of said slit in opposite directions from each other and coacting with said liner and said anvil to form oil chambers when said anvil is in predetermined angular positions with respect to said liner for causing oil pressure sealed in said oil chambers to produce impact torques, said liner having an elliptic inner periphery, said two blades having their outer edges beveled in different directions whereby a line connecting the tips of the two blades will be offset with respect to the anvil axis of rotation, said anvil having a pair of anvil sealing ridges extending parallel to the anvil axis of rotation on the outer periphery thereof at the opposite ends of a line through the anvil axis of rotation and perpendicular to said longitudinal slit, and said liner having on its inner periphery an opposed pair of first sealing ridges extending parallel to the liner axis of rotation and at positions corresponding to the ends of the minor axis of the elliptic shape of the inner periphery, a single sealing ridge extending parallel to the liner axis of rotation and at a position corresponding to one end of the major axis of the elliptic shape of the inner periphery and two further sealing ridges extending parallel to the liner axis of rotation and at positions corresponding to the other end of the major axis and spaced circumferentially of the liner a distance for causing said blades to be simultaneously engaged with said single sealing ridge and one of said two further sealing ridges only once during each rotation of said liner.

2. A hydraulic pulse wrench as claimed in claim 1, further comprising an oil supply unit in open communication with said liner for replenishing oil in said oil chambers.

* * * * *